US007712861B2

(12) United States Patent
Oku

(10) Patent No.: US 7,712,861 B2
(45) Date of Patent: May 11, 2010

(54) IMAGE FORMING APPARATUS AND DROPLET EJECTION CORRECTION METHOD

(75) Inventor: Seiichiro Oku, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 413 days.

(21) Appl. No.: 11/730,379

(22) Filed: Mar. 30, 2007

(65) Prior Publication Data

US 2007/0229559 A1 Oct. 4, 2007

(30) Foreign Application Priority Data

Mar. 31, 2006 (JP) ..... 2006-100298

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 4,328,504 A * 5/1982 Weber et al. ..... 347/14
5,552,810 A 9/1996 Matsuo
2005/0094508 A1* 5/2005 Seo ..... 369/44.29

FOREIGN PATENT DOCUMENTS

JP 5-238012 A 9/1993
JP 6-166247 A 6/1994
JP 6-198866 A 7/1994
JP 6-297728 A 10/1994
JP 7-266582 A 10/1995

* cited by examiner

*Primary Examiner*—Julian D Huffman
(74) *Attorney, Agent, or Firm*—Birch, Stewart, Kolasch & Birch, LLP

(57) ABSTRACT

The image forming apparatus includes: an image forming device which has a plurality of nozzles performing droplet ejection of ink to deposit droplets of the ink to form an image onto a prescribed medium; an image reading device which acquires read image data by reading in the image on the medium; a deviation amount calculation device which, for each of the nozzles, calculates a current deviation amount that is a deviation amount in the droplet ejection with respect to a prescribed central value, by finding a weighted average of an initial deviation amount and past N deviation amounts nearest to a current time calculated for the nozzle according to past read image data; and a droplet ejection correction device which corrects the droplet ejection of each of the nozzles according to the current deviation amount of the nozzle calculated by the deviation amount calculation device.

4 Claims, 9 Drawing Sheets

IMAGE FORMING APPARATUS AND DROPLET EJECTION CORRECTION METHOD

BACKGROUND OF THE INVENTION

1. Field of the Invention

The present invention relates to an image forming apparatus and a droplet ejection correction method, and more particularly, to an image forming apparatus for correcting droplet ejection in cases where images are formed by droplet ejection and a droplet ejection correction method.

2. Description of the Related Art

Among image forming apparatuses which form images by ejecting and depositing droplets of ink onto a medium, such as paper, apparatuses are known which read in an image formed on a medium and correct ink droplet ejection on the basis of the reading results (see, for example, Japanese Patent Application Publication Nos. 5-238012, 6-166247, 6-198866 and 7-266582).

Furthermore, an image forming apparatus is also known which reads in an image formed on a medium and determines ejection failure nozzles on the basis of the reading results (see, for example, Japanese Patent Application Publication No. 6-297728).

In a so-called single-pass image forming apparatus which forms images by moving a medium, such as paper, once only, with respect to a head having a plurality of nozzles, any variation in the droplet ejection between respective nozzles, such as variation in the direction of flight of the ejected droplets and variation in the ejected droplet volumes, directly produces image abnormalities, such as so-called "banding", or the like.

In an image forming apparatus of this kind, naturally, better reliability of the head is achieved, but even in this case, if using a head having a very large number of nozzles, it is not possible to avoid droplet ejection variations which occur with a certain probability.

If it is sought to correct droplet ejection on the basis of image reading results, in order to avoid image deterioration due to variations in droplet ejection, then "instable variations" present a major problem. More specifically, if the variation in the droplet ejection is "relatively stable variation" which involves gradual variation over time, then if images containing relatively stable variation of this kind are read in and correction is performed directly on this basis, then an effect in maintaining high image quality is obtained; but if the variation in droplet ejection is "instable variation" which involves sudden variation over time, then even if images containing "instable variation" of this kind are read in and correction is performed directly on this basis, when the correction is actually implemented, it is possible that the direction of variation will have changed (in other words, the direction of flight of the ejected droplets or the direction of increase or decrease in the ejection droplet volume will have changed), and in cases such as this, the deterioration of the image may actually be exacerbated. In other words, there is a problem in that high-frequency noise components adversely affect the correction.

Well-known and commonly used methods for removing high-frequency noise components are simple averaging, such as arithmetic averaging, and filtering of the high-frequency components, but in the case of an image forming apparatus, increasing the number of measurement operations so as to achieve effective noise removal means increasing the number of prints or increasing the number of test patterns. Therefore, it is not possible to increase the number of measurement operations, readily.

Japanese Patent Application Publication Nos. 5-238012, 6-166247, 6-198866, 7-266582, and 6-297728 mentioned above do not make any concrete description of the problem of dealing with temporal variation in droplet ejection, and nor do they present ways of resolving this problem.

Japanese Patent Application Publication No. 6-198866 discloses a general averaging process between pixels, namely, a process which uses the average value of the adjacent pixels to each pixel (dot) output, (for example, the average of three pixels), as the output for that pixel, in order to reduce the effects of noise and reading error, but it does not discuss how to deal with temporal variations in droplet ejection.

SUMMARY OF THE INVENTION

The present invention has been contrived in view of the foregoing circumstances, an object thereof being to provide an image forming apparatus and a droplet ejection correction method whereby, even if temporal variation occurs in droplet ejection when forming images by ejecting and depositing droplets, accurate correction of the droplet ejection can be implemented.

In order to attain the aforementioned object, the present invention is directed to an image forming apparatus, comprising: an image forming device which has a plurality of nozzles performing droplet ejection of ink to deposit droplets of the ink to form an image onto a prescribed medium; an image reading device which acquires read image data by reading in the image on the medium; a deviation amount calculation device which, for each of the nozzles, calculates a current deviation amount that is a deviation amount in the droplet ejection with respect to a prescribed central value, by finding a weighted average of an initial deviation amount and past N deviation amounts nearest to a current time calculated for the nozzle according to past read image data; and a droplet ejection correction device which corrects the droplet ejection of each of the nozzles according to the current deviation amount of the nozzle calculated by the deviation amount calculation device.

According to this aspect of the present invention, since the current deviation amount is calculated for each nozzle by finding a weighted average between the initial deviation amount and the past N deviation amounts nearest to the current time, and since droplet ejection is corrected for each nozzle on the basis of the current deviation amount that includes a component of the initial deviation amount in this way, then even if temporal variation occurs in the droplet ejection, the current deviation amount can still be ascertained accurately, and hence the droplet ejection can be corrected accurately. Since the current deviation amount is calculated by using the weighted value of the initial deviation amount, then it is possible to ascertain the current deviation amount accurately, and to achieve accurate correction of droplet ejection, without having to increase the number of prints or test patterns made.

Preferably, the deviation amount includes one of a deviation amount in a position of a dot formed by the droplet of the ink deposited on the medium, a deviation amount in a size of the dot, and a deviation amount in density of the dot.

In order to attain the aforementioned object, the present invention is also directed to an image forming apparatus, comprising: an image forming device which has a plurality of nozzles performing droplet ejection of ink to deposit droplets of the ink to form an image onto a prescribed medium; an image reading device which acquires read image data by reading in the image on the medium; a deviation amount calculation device which, for each of the nozzles, calculates a deviation amount in the droplet ejection with respect to a prescribed central value according to the read image data; a droplet ejection correction device which corrects the droplet ejection of each of the nozzles according to the deviation amount of the nozzle; a storage device which stores a maximum tolerable value for a temporal variation in the deviation amount of each of the nozzles; and a control device which, for each of the nozzles, compares the temporal variation in the deviation amount with the maximum tolerable value stored in the storage device, and implements control which discards the deviation amount relating to a period where the temporal variation in the deviation amount exceeds the maximum tolerable value, in such a manner that that deviation amount is not used in correcting the droplet ejection of the nozzle.

According to this aspect of the present invention, since the temporal variation in the deviation amount in droplet ejection of each nozzle is compared with the maximum tolerable value stored in the storage device, and since the deviation amount in droplet ejection for any nozzle relating to a period where the temporal variation in the deviation amount in droplet ejection of the nozzle exceeds the maximum tolerable value is discarded and is not used in correcting the droplet ejection of the nozzle, then it is possible to ascertain the deviation amount in droplet ejection accurately, and hence to correct the droplet ejection accurately, without increasing the number of measurements of the deviation amount, even in cases where there is temporal variation in the droplet ejection.

In order to attain the aforementioned object, the present invention is also directed to an image forming apparatus, comprising: an image forming device which has a nozzle performing droplet ejection of ink to deposit droplets of the ink to form an image onto a prescribed medium; an image reading device which acquires read image data by reading in the image on the medium; a deviation amount calculation device which calculates a deviation amount in the droplet ejection of the nozzle with respect to a prescribed central value according to the read image data; a droplet ejection correction device which corrects the droplet ejection of the nozzle according to the deviation amount; a storage device which stores a past deviation amount in the droplet ejection of the nozzle; and a control device which measures the deviation amount by using the image forming device, the image reading device and the deviation amount calculation device, before and after performing a maintenance operation to restore a state of the ink in the nozzle, judges whether or not a differential between the deviation amount measured before the maintenance operation and the deviation amount measured after the maintenance operation is within a prescribed range, and implements control in such a manner that, when the differential is within the prescribed range, then the droplet ejection of the nozzle is corrected by the droplet ejection correction device according to at least one of the deviation amount measured after the maintenance operation and the deviation amount measured before the maintenance operation, whereas when the differential is not within the prescribed range, then the droplet ejection of the nozzle is corrected by the droplet ejection correction device according to the past deviation amount stored in the storage device.

According to this aspect of the present invention, if the differential between the deviation amounts before and after a maintenance operation does not lie within a prescribed range, then droplet ejection correction is performed on the basis of a past deviation amount stored in the storage device, and therefore it is possible to correct droplet ejection accurately, without increasing the number of measurements of the deviation amount, even in cases where variation may arise in the deviation amount before and after a maintenance operation.

In order to attain the aforementioned object, the present invention is also directed to an image forming apparatus, comprising: an image forming device which has a nozzle performing droplet ejection of ink to deposit droplets of the ink to form an image onto a prescribed medium; an image reading device which acquires read image data by reading in the image on the medium; a deviation amount calculation device which calculates a deviation amount in the droplet ejection of the nozzle with respect to a prescribed central value according to the read image data; a droplet ejection correction device which corrects the droplet ejection of the nozzle according to the deviation amount; and a control device which, in a high-precision measurement mode, measures the deviation amount by using the image forming device, the image reading device and the deviation amount calculation device at a prescribed speed, and in a high-speed measurement mode, measures the deviation amount by using the image forming device, the image reading device and the deviation amount calculation device at a higher speed than in the high-precision measurement mode, wherein the control device normally measures the deviation amount in the high-speed measurement mode and corrects the droplet ejection of the nozzle by means of the droplet ejection correction device according to the deviation amount measured in the high-speed measurement mode, whereas when the deviation amount measured in the high-speed measurement mode does not satisfy prescribed conditions, then the control device measures the deviation amount in the high-precision measurement mode and corrects the droplet ejection of the nozzle by means of the droplet ejection correction device according to the deviation amount measured in the high-precision measurement mode.

According to this aspect of the present invention, the deviation amount in droplet ejection is normally measured in the high-speed measurement mode and the droplet ejection is corrected on the basis of this deviation amount, whereas if this deviation amount does not satisfy prescribed conditions, then the droplet ejection is corrected on the basis of a deviation amount measured in the high-precision measurement mode, and therefore it is possible to ascertain the deviation amount in droplet ejection accurately, and hence to correct the droplet ejection accurately, without lowering the operating rate of the image forming apparatus, even in cases where there is temporal variation in the droplet ejection.

Preferably, the control device normally measures the deviation amount in the high-speed measurement mode and corrects the droplet ejection of the nozzle according to the deviation amount measured in the high-speed measurement mode when the deviation amount measured in the high-speed measurement mode is within a prescribed first range, whereas when the deviation amount measured in the high-speed measurement mode is not within the first range, then the control device measures the deviation amount again in the high-speed measurement mode after performing a maintenance operation for restoring a state of the ink in the nozzle, and when a differential between the deviation amount measured in the high-speed measurement mode before the maintenance operation and the deviation amount measured in the high-speed measurement mode after the maintenance operation is within a prescribed second range, then the control device also measures the deviation amount in the high-precision measurement mode and corrects the droplet ejection of the nozzle according to the deviation amount measured in the high-precision measurement mode, whereas when the differential is not within the second range, then the control device corrects the droplet ejection of the nozzle according to a past deviation amount in the droplet ejection of the nozzle stored in a prescribed storage device.

In order to attain the aforementioned object, the present invention is also directed to an image forming apparatus, comprising: an image forming device which has a nozzle performing droplet ejection of ink to deposit droplets of the ink to form an image onto a prescribed medium; an image reading device which acquires read image data by reading in the image on the medium; a deviation amount calculation device which calculates a deviation amount in the droplet ejection of the nozzle with respect to a prescribed central value according to the read image data; a droplet ejection correction device which corrects the droplet ejection of the nozzle according to the deviation amount; a storage device which stores the deviation amount; and a control device which, in a high-precision measurement mode, measures the deviation amount by using the image forming device, the image reading device and the deviation amount calculation device at a prescribed speed, and in a high-speed measurement mode, measures the deviation amount by using the image forming device, the image reading device and the deviation amount calculation device at a higher speed than in the high-precision measurement mode, wherein: the control device measures the deviation amount in the high-precision measurement mode, and stores the deviation amount measured in the high-speed measurement mode in the storage device; the control device measures the deviation amount in the high-speed measurement mode, performs ejection failure detection for the nozzle according to the deviation amount measured in the high-speed measurement mode, and performs a droplet ejection correction according to a result of the ejection failure detection; and the control device also corrects the droplet ejection of the nozzle by means of the droplet ejection correction device according to the deviation amount of the nozzle previously measured in the high-precision measurement mode and stored in the storage device.

According to this aspect of the present invention, the deviation amount in droplet ejection is measured in the high-speed measurement mode and ejection failure detection is performed on the basis of this deviation amount, while droplet ejection is corrected on the basis of a deviation amount in droplet ejection measured previously in the high-precision measurement mode, and therefore it is possible to ascertain the deviation amount in droplet ejection accurately, and hence to correct the droplet ejection accurately, without lowering the operating rate of the image forming apparatus, even in cases where there is temporal variation in the droplet ejection.

In order to attain the aforementioned object, the present invention is also directed to a droplet ejection correction method, comprising the steps of: performing droplet ejection of ink from a plurality of nozzles to deposit droplets of the ink to form an image onto a prescribed medium; acquiring read image data by reading in the image on the medium; calculating, for each of the nozzles, a current deviation amount that is a deviation amount in the droplet ejection with respect to a prescribed central value, by finding a weighted average of an initial deviation amount and past N deviation amounts nearest to a current time calculated for the nozzle according to past read image data; and correcting the droplet ejection of each of the nozzles according to the current deviation amount of the nozzle calculated in the calculating step.

In order to attain the aforementioned object, the present invention is also directed to a droplet ejection correction method, comprising the steps of: performing droplet ejection of ink from a plurality of nozzles to deposit droplets of the ink to form an image onto a prescribed medium; acquiring read image data by reading in the image on the medium; calculating, for each of the nozzles, a deviation amount in the droplet ejection with respect to a prescribed central value according to the read image data; correcting the droplet ejection of each of the nozzles according to the deviation amount of the nozzle calculated in the calculating step; and comparing, for each of the nozzles, a temporal variation in the deviation amount with a maximum tolerable value stored in a prescribed storage device, and discarding the deviation amount relating to a period where the temporal variation in the deviation amount exceeds the maximum tolerable value, in such a manner that that deviation amount is not used in the correcting step.

In order to attain the aforementioned object, the present invention is also directed to a droplet ejection correction method, comprising the steps of: performing droplet ejection of ink from a nozzle to deposit droplets of the ink to form an image onto a prescribed medium; acquiring read image data by reading in the image on the medium; calculating a deviation amount in the droplet ejection of the nozzle with respect to a prescribed central value according to the read image data; performing a maintenance operation to restore a state of the ink in the nozzle; and measuring the deviation amount by the droplet ejection performing step, the read image data acquiring step and the deviation amount calculating step, before and after the maintenance operation performing step, judging whether or not a differential between the deviation amount measured before the maintenance operation performing step and the deviation amount measured after the maintenance operation performing step is within a prescribed range, and when the differential is within the prescribed range, then correcting the droplet ejection of the nozzle according to at least one of the deviation amount measured after the maintenance operation performing step and the deviation amount measured before the maintenance operation performing step, whereas when the differential is not within the prescribed range, correcting the droplet ejection of the nozzle according to a past deviation amount in the droplet ejection of the nozzle stored in a prescribed storage device.

In order to attain the aforementioned object, the present invention is also directed to a droplet ejection correction method, comprising the steps of: performing droplet ejection of ink from a nozzle to deposit droplets of the ink to form an image onto a prescribed medium; acquiring read image data by reading in the image on the medium; calculating a deviation amount in the droplet ejection of the nozzle with respect to a prescribed central value according to the read image data; measuring, in a high-precision measurement mode, the deviation amount by the droplet ejection performing step, the read image data acquiring step and the deviation amount calculating step, at a prescribed speed; measuring, in a high-speed measurement mode, the deviation amount by the droplet ejection performing step, the read image data acquiring step and the deviation amount calculating step, at a higher speed than in the high-precision measurement mode; and normally measuring the deviation amount in the high-speed measurement mode and correcting the droplet ejection of the nozzle according to the deviation amount measured in the high-speed measurement mode, whereas when the deviation amount measured in the high-speed measurement mode does not satisfy prescribed conditions, then measuring the deviation amount in the high-precision measurement mode and correcting the droplet ejection of the nozzle according to the deviation amount measured in the high-precision measurement mode.

Preferably, the droplet ejection correction method further comprises the step of performing a maintenance operation to restore a state of the ink in the nozzle, wherein the deviation amount is normally measured in the high-speed measurement mode and the droplet ejection of the nozzle is corrected according to the deviation amount measured in the high-speed measurement mode when the deviation amount measured in the high-speed measurement mode is within a prescribed first range, whereas when the deviation amount measured in the high-speed measurement mode is not within the first range, then the deviation amount is measured again in the high-speed measurement mode after the maintenance operation performing step, and when a differential between the deviation amount measured in the high-speed measurement mode before the maintenance operation performing step and the deviation amount measured in the high-speed measurement mode after the maintenance operation performing step is within a prescribed second range, then the deviation amount is also measured in the high-precision measurement mode and the droplet ejection of the nozzle is corrected according to the deviation amount measured in the high-precision measurement mode, whereas when the differential is not within the second range, then the droplet ejection of the nozzle is corrected according to a past deviation amount in the droplet ejection of the nozzle stored in a prescribed storage device.

In order to attain the aforementioned object, the present invention is also directed to a droplet ejection correction method, comprising the steps of: performing droplet ejection of ink from a nozzle to deposit droplets of the ink to form an image onto a prescribed medium; acquiring read image data by reading in the image on the medium; calculating a deviation amount in the droplet ejection of the nozzle with respect to a prescribed central value according to the read image data; measuring, in a high-precision measurement mode, the deviation amount by the droplet ejection performing step, the read image data acquiring step and the deviation amount calculating step, at a prescribed speed; measuring, in a high-speed measurement mode, the deviation amount by the droplet ejection performing step, the read image data acquiring step and the deviation amount calculating step, at a higher speed than in the high-precision measurement mode; measuring the deviation amount in the high-speed measurement mode, performing ejection failure detection for the nozzle according to the deviation amount measured in the high-speed measurement mode, and performing a droplet ejection correction according to a result of the ejection failure detection; and correcting the droplet ejection of the nozzle according to a deviation amount of the nozzle previously measured in the high-precision measurement mode and stored in a prescribed storage device.

According to the present invention, when forming images by means of droplet ejection, it is possible to correct droplet ejection accurately, even if there is temporal variation in the droplet ejection.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Image Forming Apparatus

Figure 1:
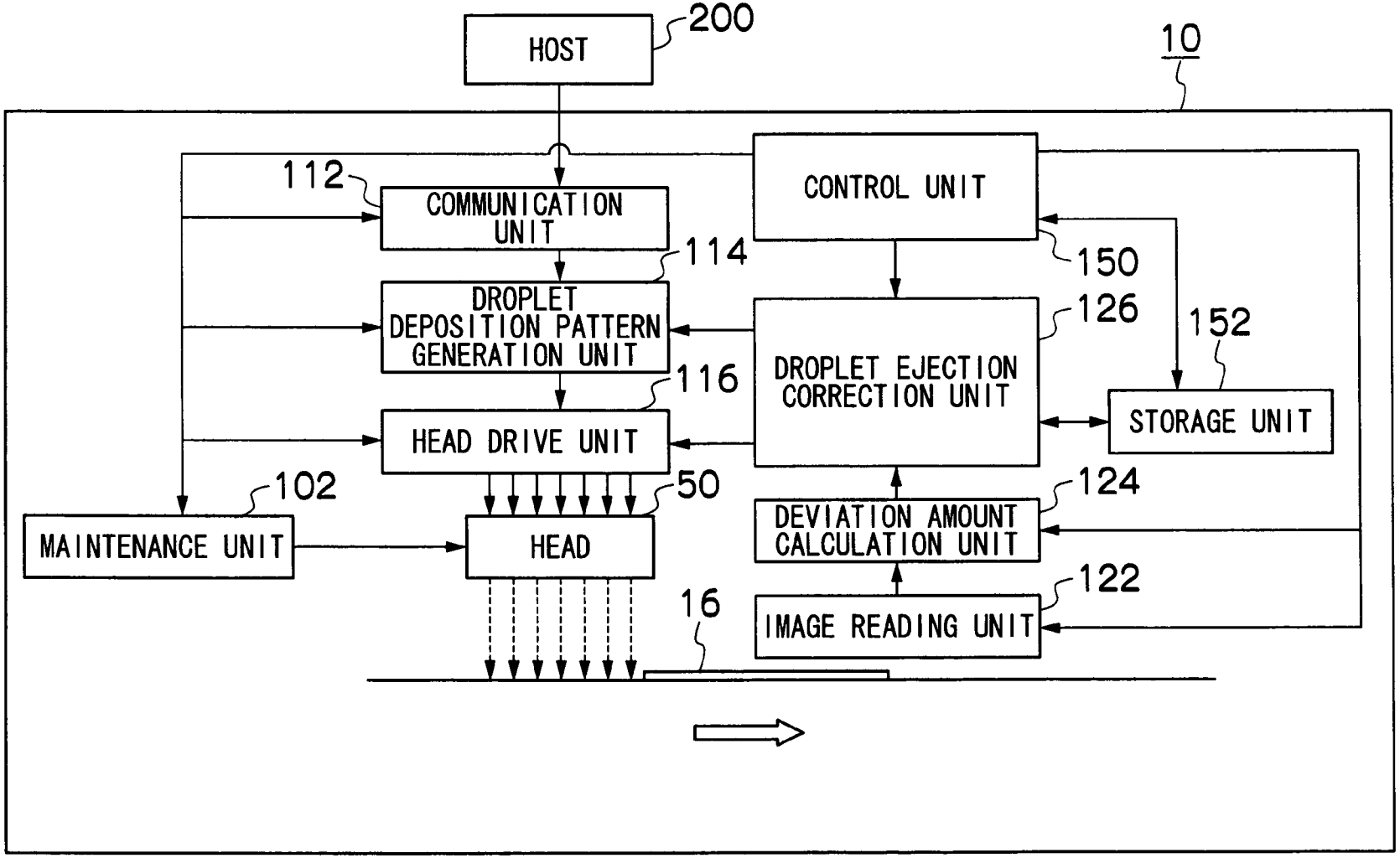
FIG. 1 is a block diagram showing the general composition of an image forming apparatus according to an embodiment of the present invention.

FIG. 1 is a block diagram showing the general composition of an image forming apparatus according to an embodiment of the present invention.

In FIG. 1, the image forming apparatus 10 includes: an ink droplet ejection head (hereinafter referred to as the head) 50, a maintenance unit 102, a communication unit 112, a droplet deposition pattern generation unit 114, a head drive unit 116, an image reading unit 122, a deviation amount calculation unit 124, a droplet ejection correction unit 126, a control unit 150 and a storage unit 152.

This head 50 has a plurality of nozzles which eject droplets of ink. By ejecting droplets of ink from the nozzles toward the medium 16, such as paper, an image composed of a plurality of dots formed from the deposited ink droplets is formed on the medium 16. A concrete embodiment of the head 50 is described in detail later.

The maintenance unit 102 performs a maintenance operation for restoring the state of the ink in the head 50 (and in particular, the state of the ink inside the nozzles). A concrete embodiment of the maintenance unit 102 is described in detail later.

The communication unit 112 functions as an image data input device, which receives image data transmitted by a host 200. It is possible to use a wired or wireless interface for the communication unit 112.

On the basis of the image data, the droplet deposition pattern generation unit 114 generates droplet deposition pattern data required in order to form dots on the medium 16 by depositing ink droplets from the nozzles of the head 50 onto the medium 16. In other words, the droplet deposition pattern generation unit 114 converts the image data into the droplet deposition pattern data.

Here, the image data is either data for forming an actual image desired by the user, as received from the host 200, or test image data for measuring the deviation amount.

The droplet deposition pattern data is data that indicates the droplet deposition positions and the droplet ejection volumes. The data may be data of a simple format that simply indicates whether each nozzle is designated to perform droplet ejection.

The head drive unit 116 supplies drive signals for droplet ejection to the head 50, on the basis of the droplet deposition pattern data.

The image reading unit 122 optically reads in the image (droplet deposition result) formed on the medium 16 and thereby obtains density data (read image data). The image reading unit 122 includes image sensors (imaging devices), such as CCD (charge coupled device) sensors, CMOS (complementary metal oxide semiconductor) sensors, or the like. The image sensors may be arranged in a one-dimensional configuration or a two-dimensional configuration. Furthermore, the image reading unit is not limited to a case where it is built in the image forming apparatus 10, as shown in FIG. 1, and it is also possible to provide the image reading unit as a separate unit having a scanning mechanism (a so-called image scanner), outside of the image forming apparatus 10.

In order to correct droplet ejection, it is possible to form a test image for determining variations in droplet ejection, such as a solid image or a fine line image, on the medium 16. The test image data may be one sheet or a plurality of sheets of special image data held in the image forming apparatus 10. Moreover, it is also possible to provide a special region to be read at the end section of the medium 16, and to prepare the test image data for an image to be formed on the special region. Furthermore, it is also possible to use the actual image data received from the host 200, as test image data.

The deviation amount calculation unit 124 calculates the deviation amounts from the central design values of the droplet ejection, for each nozzle in the head 50, on the basis of the density data acquired by the image reading unit 122 (the read image data).

Here, the deviation amounts in droplet ejection include: the deviation amount in the position of the deposited droplet (dot position), the deviation amount in the size of the deposited droplet (size of dot) (for example, the deviation amount in the diameter of the deposited droplet (diameter of the dot) or the deviation amount in the volume of the ejected droplet), the deviation amount in the density (the density at the respective positions on the medium 16 that correspond to the central positions of the respective nozzles), and the like. In other words, the deviation amount in droplet ejection may be the deviation amount relating the position of the deposited droplet or the deviation amount relating to the volume of the deposited droplet.

The storage unit 152 stores information of various types. The storage unit 152 according to the present embodiment stores information relating to variations in droplet ejection, in particular, the history of the deviation amounts in droplet ejection, the tolerable ranges of the deviation amounts, the tolerable ranges of the temporal variations in the deviation amounts, and the like.

The droplet ejection correction unit 126 calculates droplet ejection correction data on the basis of the deviation amounts calculated by the deviation amount calculation unit 124, and it corrects the droplet ejection of the head 50 on the basis of this droplet ejection correction data.

The possible of modes of droplet ejection correction are: firstly, a mode based on correcting the droplet deposition pattern data generated by the droplet deposition pattern generation unit 114 (hereinafter referred to as "droplet deposition pattern correction"), and secondly, a mode based on correcting the drive signal for droplet ejection applied to the head 50 from the head drive unit 116 (hereinafter referred to as "drive signal correction").

In the droplet deposition pattern correction, first droplet deposition pattern data is generated by the droplet deposition pattern generation unit 114, on the basis of the image data received from the host 200, while on the other hand, droplet ejection correction data is calculated by the droplet ejection correction unit 126 on the basis of the deviation amounts in droplet ejection, and the droplet ejection correction data is supplied to the droplet deposition pattern generation unit 114. The droplet deposition pattern generation unit 114 generates second droplet deposition pattern data required for actual driving of the head 50, on the basis of the first droplet deposition pattern data and the droplet ejection correction data, and supplies the second droplet deposition pattern to the head drive unit 116. In practice, the head drive unit 116 generates a drive signal on the basis of the second droplet deposition pattern data, and supplies the drive signal to the head 50.

The droplet deposition pattern correction may be, for example, correction that increases the diameter of the droplets ejected from the nozzles in the vicinity of a nozzle having low density, or correction that increases the number of droplet ejecting actions performed by the nozzles in the vicinity of a nozzle having low density, and the like.

In the drive signal correction, droplet deposition pattern data is generated by the droplet deposition pattern generation unit 114, on the basis of the image data received from the host 200, and the droplet deposition pattern data is supplied to the head drive unit 116, while on the other hand, droplet ejection correction data is calculated by the droplet ejection correction unit 126 on the basis of the deviation amounts in droplet ejection and the droplet ejection correction data is supplied to the head drive unit 116. The head drive unit 116 generates a drive signal on the basis of the droplet deposition pattern data and the droplet ejection correction data, and supplies the drive signal to the head 50.

The drive signal correction may be, for example, correction of the voltage (drive voltage) of the drive signal, correction of the waveform of the drive signal (drive waveform), and the like.

The control unit 150 controls the respective units of the image forming apparatus 10, such as the maintenance unit 102, the communication unit 112, the droplet deposition pattern generation unit 114, the head drive unit 116, the image reading unit 122, the deviation amount calculation unit 124, the droplet ejection correction unit 126, and the like. The specific droplet ejection correction processing, which is controlled by the control unit 150, is described in detail later.

Head

Figure 2A:
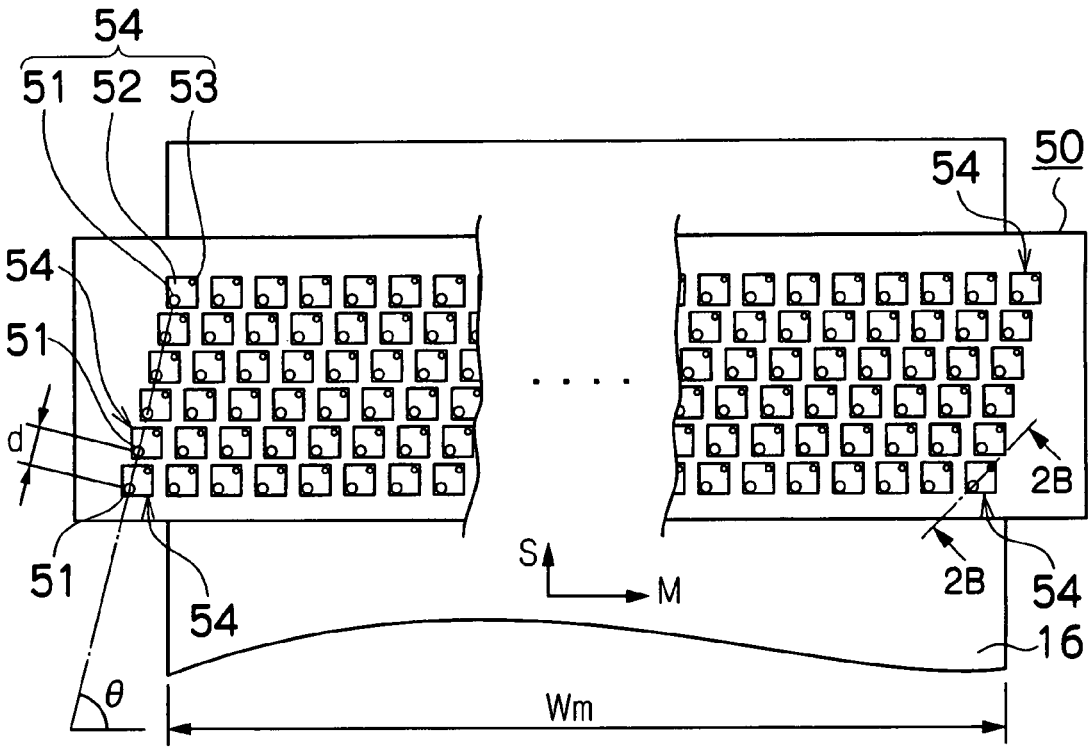
FIGS. 2A and 2B are a plan view perspective diagram and a cross-sectional diagram showing the whole of a head in the image forming apparatus.

FIG. 2A is a plan view perspective diagram showing the basic overall structure of the head 50 in FIG. 1.

The droplet ejection head 50 shown in FIG. 2A is a so-called full line head, having a structure in which a plurality of nozzles 51 which eject ink droplets toward the medium 16 are arranged in a two-dimensional configuration through a length corresponding to the width Wm of the medium 16 in the direction perpendicular to the direction of conveyance of the medium 16 (the sub-scanning direction indicated by arrow S in FIG. 2A), in other words, in the main scanning direction indicated by arrow M in FIG. 2A.

The head 50 includes a plurality of pressure chamber units 54, each having the nozzle 51, a pressure chamber 52 connected to the nozzle 51, and a ink supply port 53, the pressure chamber units 54 being arranged in two directions, namely, the main scanning direction M and an oblique direction forming a prescribed acute angle θ (where $0° < \theta < 90°$) with respect to the main scanning direction M. In FIG. 2A, in order to simplify the drawing, only a portion of the pressure chamber units 54 are depicted in the drawing.

More specifically, the nozzles 51 are arranged at a uniform pitch d in the direction forming the prescribed acute angle of θ with respect to the main scanning direction M, and hence the nozzle arrangement can be treated as equivalent to a configuration in which the nozzles are arranged at an interval of d×cos θ in a straight line following the main scanning direction M.

Figure 2B:
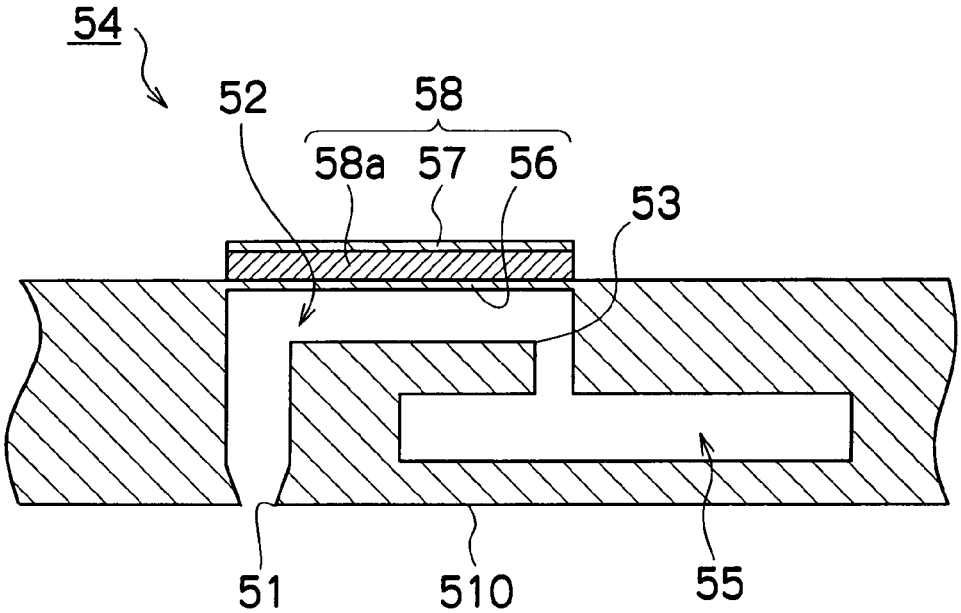

FIG. 2B shows a cross-sectional diagram along line 2B-2B in FIG. 2A of one of the aforementioned pressure chamber units 54, which forms one of the droplet ejection elements constituting the head 50.

As shown in FIG. 2B, each pressure chamber 52 is connected to a common liquid chamber 55 through the ink supply port 53. The common liquid chamber 55 is connected to a tank which forms a liquid supply tank (not shown), and the liquid supplied from the tank is distributed and supplied to the respective pressure chambers 52 by means of the common liquid chamber 55.

A piezoelectric body 58*a* is disposed on a diaphragm 56, which constitutes the ceiling of the pressure chamber 52, and an individual electrode 57 is arranged on the piezoelectric body 58*a*. The diaphragm 56 is earthed and also functions as a common electrode. A piezoelectric actuator 58, which forms a device for generating a liquid ejection pressure, is constituted by the diaphragm 56, the individual electrode 57 and the piezoelectric body 58*a*.

When a prescribed drive voltage is applied to the individual electrode 57 of the piezoelectric actuator 58, the piezoelectric body 58*a* deforms, thereby changing the volume of the pressure chamber 52, and this results in a change in the pressure inside the pressure chamber 52, which causes the liquid in the pressure chamber 52 to be ejected from the nozzle 51 as a droplet. When the volume of the pressure chamber 52 returns to normal after droplet ejection, new liquid is supplied to the pressure chamber 52 from the common liquid chamber 55 through the ink supply port 53.

FIG. 2A shows the embodiment where the nozzles 51 are arranged two-dimensionally in order to achieve a structure whereby a high-resolution image can be formed at high-speed onto the medium 16, but the head used in the present invention is not limited in particular to a structure in which the nozzles 51 are arranged two-dimensionally, and it may also adopt a structure where the nozzles 51 are arranged one-dimensionally. Furthermore, the pressure chamber unit 54 shown in FIG. 2B is merely an example of a droplet ejection element constituting a part of the head, and the invention is not limited in particular to this. For example, instead of disposing the common liquid chamber 55 below the pressure chamber 52 (in other words, towards the nozzle face 510 from the pressure chamber 52), it is also possible to dispose the common liquid chamber 55 above the pressure chamber 52 (in other words, on the reverse side from the nozzle face 510). Furthermore, it is also possible to generate a liquid droplet ejection force by using heating bodies instead of piezoelectric bodies 58*a*, for example.

Maintenance Unit

Figure 3:
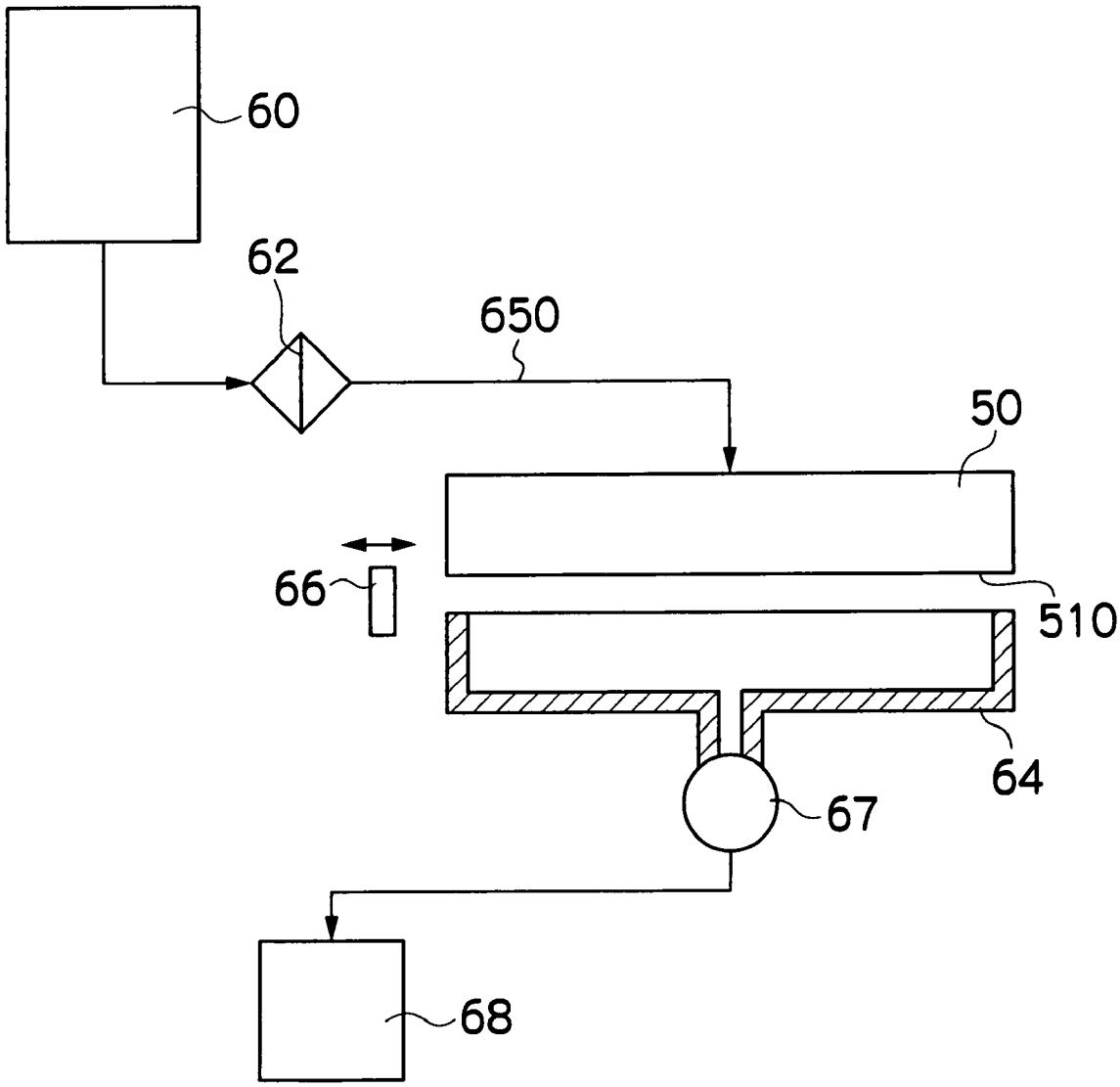
FIG. 3 is an illustrative diagram used to describe maintenance for restoring the state of the liquid.

FIG. 3 is an illustrative diagram used to describe the maintenance unit 102 in the image forming apparatus 10 shown in FIG. 1.

The tank 60 is a base tank for supplying ink to the head 50. A filter 62 for eliminating foreign mater and bubbles is provided at an intermediate position of a tubing 650 (ink supply channel), which connects the tank 60 with the head 50.

The image forming apparatus 10 is further provided with: a cap 64 forming a device for preventing drying of the ink surface in the nozzles 51 or preventing increase in the ink viscosity in the vicinity of the ink surface during a prolonged idle period without droplet ejection; and a cleaning blade 66 forming a device for cleaning the nozzle face 510.

A unit including the cap 64 and the cleaning blade 66 can be relatively moved with respect to the head 50 by a movement mechanism (not shown), and is moved from a predetermined holding position to a maintenance position below the head 50, as and when required.

Furthermore, the cap 64 is relatively raised and lowered with respect to the head 50 by an elevator mechanism (not shown). The elevator mechanism raises the cap 64 to a predetermined elevated position so as to come into close contact with the head 50, and at least the nozzle region of the nozzle face 510 is thus covered by the cap 64.

The cleaning blade 66 is composed of rubber or another elastic member, and can slide on the nozzle face 510 of the head 50 by means of a cleaning blade movement mechanism (not shown). If there are ink droplets or foreign matter adhering to the nozzle face 510, then the nozzle face 510 is wiped by causing the cleaning blade 66 to slide over the nozzle face 510, thereby cleaning same.

A suction pump 67 suctions ink from the nozzles 51 of the head 50 and sends the suctioned ink to a recovery tank 68 in a state where the nozzle face 510 of the head 50 is covered by the cap 64.

A suction operation of this kind is performed when ink is filled into the head 50 from the tank 60 when the tank 60 is installed in the image forming apparatus 10 (initial filling), and it is also performed when removing ink of increased viscosity after the apparatus has been out of use for a long period of time (start of use after long period of inactivity).

Furthermore, if bubbles infiltrate inside the nozzles 51 and the pressure chambers 52 of the head 50, or if the increase in the viscosity of the ink inside the nozzles 51 exceeds a certain level, then it becomes impossible to eject ink droplets from the nozzles 51 by purging (dummy droplet ejection), and therefore, the cap 64 is abutted against the nozzle face 510 of the head 50, and an operation is performed to suction out the ink containing bubbles or the ink of increased viscosity inside the pressure chambers 52 of the head 50, by means of the suction pump 67.

In the embodiment shown in FIG. 3, the maintenance unit 102 shown in FIG. 1 is principally constituted by the cap 64, the cleaning blade 66 and the suction pump 67.

Below, the droplet ejection correction processing, which is controlled by the control unit 150 shown in FIG. 1, is described in detail, separately with respect to various different embodiments.

First Embodiment

The droplet ejection correction processing according to the first embodiment is described with reference to the illustrative diagram in FIG. 4.

Figure 4:
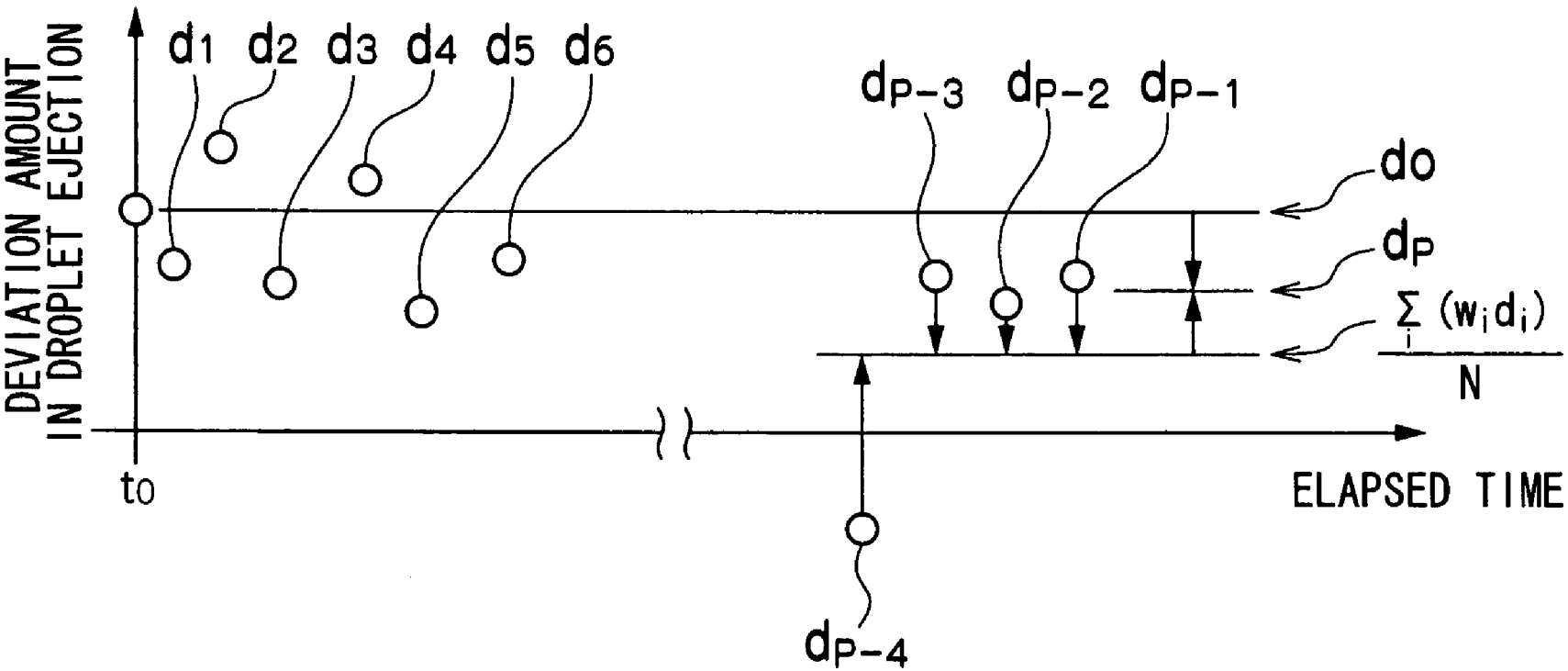
FIG. 4 is an illustrative diagram showing a droplet ejection correction process according to a first embodiment of the present invention.

FIG. 4 shows an example of temporal variation in a deviation amount in droplet ejection with respect to the central design value. Here, the vertical axis in FIG. 4 shows the deviation amount in droplet ejection and the horizontal axis shows the elapsed time since the initial time point $t_0$.

The initial time point $t_0$ is, for example, the time of the finishing checkout of the image forming apparatus 10 in the manufacturing factory, or the time of the transfer of the image forming apparatus 10 from the manufacturing factory. It is also possible that the initial time point $t_0$ is the time point at which the image forming apparatus 10 is installed for use.

It is possible that the deviation amount $d_0$ at the initial time point $t_0$ (called "initial deviation amount") is measured by using the deviation amount measurement device built in the image forming apparatus 10, constituted by the head 50, the image reading unit 122 and the deviation amount calculation unit 124 in the image forming apparatus 10, over a measurement time that is sufficiently longer than measurement made during operation of the image forming apparatus 10. A case such as this is desirable, since it means that no special deviation amount measurement device is required, and measurement of higher reliability than measurement performed during the operation of the image forming apparatus 10 can be achieved. It is also possible that the initial deviation amount $d_0$ is measured by using a special measurement device that has higher reliability than the deviation amount measurement device built in the image forming apparatus 10. Moreover, it is also possible that the initial deviation amount $d_0$ is indirectly determined, on the basis of measurement amounts that relate physically, or theoretically, to the deviation amount in droplet ejection, such as the dimensional values of the respective elements (parts) of the head 50. The initial deviation amount $d_0$ determined by any of these methods generally has higher reliability than the deviation amount measured during operation of the image forming apparatus 10.

The initial deviation amount $d_0$ is beforehand stored in the storage unit 152 in FIG. 1, before the operation of the image forming apparatus 10.

During the operation of the image forming apparatus 10, the deviation amounts shown in FIG. 4 ($d_1$ to $d_6$, and $d_{P-4}$ to $d_{P-1}$) are measured by using the deviation amount measurement device built in the image forming apparatus 10, which is constituted by the head 50, the image reading unit 122 and the deviation amount calculation unit 124 shown in FIG. 1. More specifically, as well as forming images on the media 16 by ejecting ink droplets onto the medium 16 from the nozzles 51 in the head 50 while moving the media 16 (e.g., paper) relatively with respect to the head 50 in FIG. 1, read image data is acquired by reading in the images on the media 16 by means of the image reading unit 122 in FIG. 1. The deviation amounts ($d_1$ to $d_6$, and $d_{P-4}$ to $d_{P-1}$) are calculated by the deviation amount calculation unit 124 in FIG. 1, on the basis of this read image data.

These deviation amounts ($d_1$ to $d_6$, and $d_{P-4}$ to $d_{P-1}$) are stored in the storage unit 152 in FIG. 1 as history data (in other words, past deviation amounts). It is also possible for the past deviation amounts (for example, $d_1$ to $d_6$) prior to a prescribed number (N) of measurement operations to be erased successively.

The deviation amount $d_P$ of the current ejected droplet is calculated by the deviation amount calculation unit 124 as follows:

$$d_P = \frac{\sum_i (w_i \cdot d_i)}{N} + w_0 \cdot d_0, \tag{1}$$

where i is an index (P−N to P−1) indicating each deviation amount ($d_{P-N}$ to $d_{P-1}$) of the last N measurements nearest to the current time, $w_i$ is a "weighting" which applies a weighting to each deviation amount ($d_{P-N}$ to $d_{P-1}$) of the last N measurements nearest to the current time, and $w_0$ is the "weighting" corresponding to the initial deviation amount $d_0$. This weighting $w_0$ is in the range of $0<w_0<1$.

As shown in Formula 1, the current deviation amount $d_P$ is calculated by finding the weighted average of the deviation amounts ($d_{P-N}$ to $d_{P-1}$) of the past N measurements nearest to the current time obtained previously by measurement of the deviation amounts, and the initial deviation amount $d_0$.

Desirably, the weightings $w_i$ relating to the deviation amounts ($d_{P-N}$ to $d_{P-1}$) of the past N measurements should assume a smaller value, the older the measurement to which they relate, in other words, the greater the separation in time between that measurement and the current time.

Moreover, desirably, the weight $w_0$ relating to the initial deviation amount $d_0$ is changed on the basis of the magnitude of the temporal variation in the deviation amounts of the past N measurements ($d_{P-N}$ to $d_{P-1}$) (namely, the differential of $d_{P-N}$ to $d_{P-1}$). More specifically, the greater the temporal variation in the deviation amounts, the greater the weighting $w_0$ applied to the initial deviation amount $d_0$.

Furthermore, if a deviation amount value is obtained during a period where the variation in the deviation amounts has exceeded a prescribed maximum tolerance value, then there is a high possibility that this obtained deviation amount value is noise, and therefore, it is desirable that this obtained deviation amount value is discarded, rather than being used in the calculation of the current deviation amount $d_P$. More specifically, if $|d_K-d_{K-1}|>d_{MAX}$, then the values $d_K$ and $d_{K-1}$ are discarded, where $d_{MAX}$ is the maximum tolerable value, which is specified in advance. For each of the nozzles 51, the current deviation amount $d_P$ is calculated by eliminating any unnecessary past deviation amounts. By adopting this method, it is possible to improve the accuracy of the current deviation amount $d_P$, and hence to achieve more accurate correction of droplet ejection.

It is possible that the weightings of the deviation amounts $d_{P-N}$ to $d_{P-1}$ for the past N measurements are the same weighting $w_A$, and in this case, the current deviation amount $d_P$ is expressed as:

$$d_P = w_A \cdot \frac{\sum_i d_i}{N} + w_0 \cdot d_0, \tag{2}$$

where $w_A=1-w_0$.

The current deviation amount $d_P$ is stored in the storage unit 152 as a part of the deviation amount history. Older data may be erased successively, in order.

Detailed specific examples are now described with respect to the weighting of the initial deviation amount $d_0$ and the deviation amounts ($d_{P-N}$ to $d_{P-1}$) of the past N measurements nearest to the current time. Here, the initial deviation amount $d_0$ is the deviation amount determined by the measurement upon manufacture of the image forming apparatus 10 in the factory.

In the first example, the deviation amounts are measured a plurality of times (M times) upon manufacture of the image forming apparatus 10 in the factory, and weightings are applied using this number of measurements (i.e., M). The current deviation amount $d_P$ in the first example is expressed as:

$$d_P = \frac{d_0 \cdot M + d_n \cdot N}{M + N}, \tag{3}$$

where $d_0$ is the average value of the M deviation amounts measured upon manufacture of the image forming apparatus 10 in the factory, and $d_n$ is the average value of the most recent N deviation amounts ($d_{P-N}$ to $d_{P-1}$) measured in the past.

In the second example, after the image forming apparatus 10 is installed and before becoming in use, a running test of the image forming apparatus 10 is performed, and weightings are applied by using the deviation amounts found in the running test. The current deviation amount $d_P$ in the second example is expressed as:

$$d_P = \frac{d_0 \cdot d_{t_ini} + d_n \cdot d_{t_mean}}{d_{t_ini} + d_{t_mean}}, \quad (4)$$

where $d_{t_ini}$ is the absolute value of the initial deviation amount at the start of the running test period, and $d_{t_mean}$ is the average value of the absolute values of the deviation amounts during the whole period of the running test.

It is thought that the initial deviation amount $d_0$ is principally governed by the mechanical accuracy of the nozzles and the drive characteristics of the actuators (which depend on the dimensional accuracy of the piezoelectric bodies, and the like), and the subsequent deviation amount $d_n$ is principally governed by factors such as deterioration of the actuators and displacement of the installation position of the whole head. Since these factors differ, then it is logical to suppose that variation will appear in the respective deviation amounts, due to differences in these factors.

In the third example, the running test period in the second example is divided into a number of periods (for example, within one year from the manufacture, between one and two years, between two and three years, and the like), the values of $d_{t_ini}$ and $d_{t_mean}$ are measured for each period, and the current deviation amounts $d_P$ shown in Formula 4 are calculated by using the different values of $d_{t_ini}$ and $d_{t_mean}$, in accordance with the operational time after the manufacture. The measure of the running time period is not limited to one based on time (for example, years), and it is also to use the number of prints as a basis for this.

In the third example, the weightings are altered with the passage of time. The factors that cause variation in the deviation amount include factors depending on the number of ejection actions, such as the deterioration of the piezoelectric bodies, and hence the weightings are altered in accordance with the passage of time (or the number of prints made). The weighting applied to the initial deviation amount $d_0$ may be decreased over time.

The first to third examples are described in relation to the cases where the weightings applied to the deviation amounts of the most recent past N measurements (in other words, the weightings relating to N deviation amounts) are all the same, but the present invention may also be applied to cases where the weightings applied to the deviation amounts of the past N measurements are respectively different.

In the above-described first embodiment, the control unit 150 shown in FIG. 1 forms images on prescribed media 16 by means of a head 50, and also acquires read image data by reading in the images on the media 16 by means of the image reading unit 122, calculates the deviation amounts on the basis of the read image data, by means of the deviation amount calculation unit 124, and stores the deviation amounts in the storage unit 152 as part of the deviation amount history. The initial deviation amount $d_0$ and the maximum tolerable value of the deviation amount are stored in advance in the storage unit 152. Furthermore, the control unit 150 calculates the current deviation amount $d_P$ for each of the nozzles 51, by finding the weighted average of the initial deviation amount $d_0$ and the deviation amounts ($d_{P-N}$ to $d_{P-1}$) of the past N measurements nearest to the current time, by means of the deviation amount calculation unit 124, and the control unit 150 calculates correction data on the basis of the current deviation amount $d_P$ for each of the nozzles 51. During image formation, the control unit 150 corrects droplet ejection for the respective nozzles 51 according to the thus obtained correction data. It is highly possible that the past deviation amount that shows a large temporal variation is noise, and hence such values are discarded in order that they are not used in the calculation of the current deviation amount $d_P$. For example, if the temporal variation in the deviation amounts ($d_{P-N}$ to $d_{P-1}$) of the past N measurements nearest to the current time includes variation that is greater than a prescribed volume, then droplet ejection is corrected on the basis of the deviation amount that is determined previously as the current deviation amount.

Second Embodiment

Figure 5:
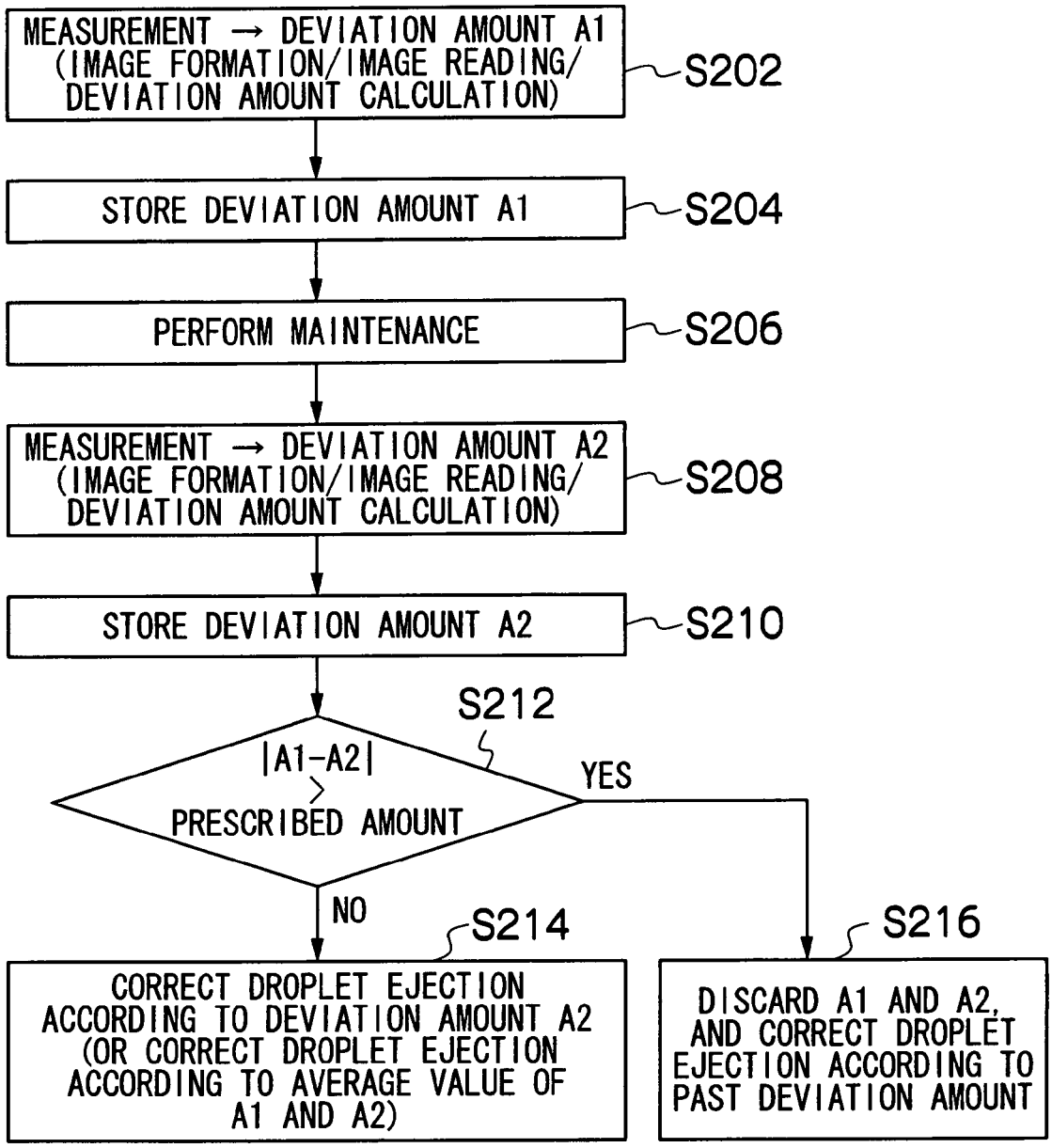
FIG. 5 is a flowchart showing an overview of a sequence of droplet ejection correction processing according to a second embodiment of the present invention.

Next, the droplet ejection correction processing according to a second embodiment of the present invention is described with reference to the flowchart in FIG. 5, which shows an overview of this processing. The droplet ejection correction processing shown in FIG. 5 is performed by the control unit 150 in FIG. 1, in accordance with a prescribed program.

Firstly, the deviation amount A1 in the droplet ejection from each nozzle 51 of the head 50 is measured by means of the head 50, the image reading unit 122 and the deviation amount calculation unit 124 shown in FIG. 1 (step S202), and the deviation amount A1 thus measured is stored in the storage unit 152 shown in FIG. 1 (step S204).

Thereupon, the maintenance unit 102 shown in FIG. 1 performs a maintenance operation for the head 50 shown in FIG. 1, such as suctioning the nozzles 51, wiping the nozzle face 510, or the like (step S206). By means of this maintenance operation, the state of the ink inside the head 50 (and in particular, the state of the ink inside the nozzles 51) is restored.

After performing the maintenance operation, the deviation amount A2 in the droplet ejection from each nozzle 51 of the head 50 is again measured by means of the head 50, the image reading unit 122 and the deviation amount calculation unit 124 shown in FIG. 1 (step S208), and the deviation amount A2 thus measured is stored in the storage unit 152 shown in FIG. 1 (step S210).

Thereupon, the differential |A1−A2| between the deviation amount A1 measured immediately before the maintenance operation and the deviation amount A2 measured immediately after the maintenance operation (i.e., the temporal variation in the deviation amount) is calculated and compared with a prescribed amount (i.e., the maximum tolerable variation) beforehand stored in the storage unit 152 (step S212). For example, the judgment in step S212 is performed for each nozzle 51.

Here, if the differential |A1−A2| is not greater than the prescribed amount, then the droplet ejection correction unit 126 in FIG. 1 calculates correction data on the basis of the deviation amount A2 (the deviation amount measured immediately after the maintenance operation), and accordingly performs droplet ejection correction (step S214).

In general, the droplet ejection correction is not performed by performing droplet ejection again toward the medium 16 on which an image has already been formed and from which the image has been read in, but by correcting droplet ejection toward the next medium that is relatively moved to the position opposing the head 50. More specifically, firstly, there is a mode in which the droplet deposition pattern data (which is generated by the droplet deposition pattern generation unit 114 in FIG. 1) of the image that is to be formed on the next medium is corrected, and secondly, there is a mode in which the drive signals (which are generated by the head drive unit 116 in FIG. 1) applied to the head 50 during droplet ejection toward the next medium are corrected, and the like.

It is also possible to correct droplet ejection on the basis of the average value of the deviation amount A1 obtained by measuring immediately before the maintenance operation, and the deviation amount A2 obtained by measuring immediately after the maintenance operation, instead of correcting droplet ejection on the basis of the deviation amount A2.

If the differential |A1−A2| is greater than the prescribed amount at step S212, then the deviation amount A1 and the deviation amount A2 are discarded in such a manner that they are not used in droplet ejection correction, in other words, any deviation amounts from a period of time in which the variation in the deviation amounts exceeds a tolerable range are discarded, and droplet ejection correction is performed by calculating correction data on the basis of the past deviation amounts stored in the storage unit 152 in FIG. 1 (step S216). In short, the droplet ejection is corrected on the basis of the deviation amounts relating to a period where the variation in the deviation amounts is within the tolerable range.

Factors that cause significant variation of the deviation amounts of the droplet ejection are, for instance, soiling in the vicinity of the nozzles 51, incorporation of bubbles, and the like. It is considered that these factors are greatly affected by the maintenance operation. Therefore, the deviation amounts before and after the maintenance operation which amounts do not show great variation, are taken as the "stable" deviation amounts, and droplet ejection is corrected on the basis of these "stable" deviation amounts.

The control unit 150 shown in FIG. 1 controls the measurement of the deviation amounts described above (which involves image formation by means of the head 50 in FIG. 1, image reading by means of the image reading unit 122 in FIG. 1, and calculation of the deviation amounts by means of the deviation amount calculation unit 124 in FIG. 1), and the droplet ejection correction by means of the droplet ejection correction unit 126 in FIG. 1.

In the second embodiment, the control unit 150 in FIG. 1 judges whether or not the differential between the deviation amount in droplet ejection of the nozzles 51 measured immediately before a maintenance operation and the deviation amount in droplet ejection of the nozzles 51 measured immediately after the maintenance operation is within the prescribed tolerable range, and if the differential is within the prescribed tolerable range, then the droplet ejection of the nozzles 51 is corrected by the droplet ejection correction unit 126 on the basis of the deviation amount in the droplet ejection of the nozzles 51 measured immediately after the maintenance operation and/or the deviation amount in the droplet ejection of the nozzles 51 measured immediately before the maintenance operation, whereas if the differential is not within the prescribed tolerable range, then the droplet ejection of the nozzles 51 is corrected by the droplet ejection correction unit 126 on the basis of the past deviation amounts in the droplet ejection of the nozzles 51, as stored in the storage unit 152.

Third Embodiment

Next, the droplet ejection correction processing according to a third embodiment of the present invention is described.

In the present embodiment, there are two modes for measuring the deviation amount in droplet ejection: a high-precision measurement mode and a high-speed measurement mode. The high-precision measurement mode measures the deviation amount in droplet ejection at a slower speed but with higher accuracy, than the high-speed measurement mode. On the other hand, the high-speed measurement mode measures the deviation amount in droplet ejection at a faster speed but with lower accuracy, than the high-precision measurement mode.

More specifically, in the high-speed measurement mode, image reading by the image reading unit 122 in FIG. 1 is performed more quickly, and the image resolution of the read image data is lower, than in the case of the high-precision measurement mode. In the high-speed measurement mode, the speed of the medium 16 that is moved relatively with respect to the image reading unit 122 in FIG. 1 is greater than in the high-precision measurement mode.

In the present embodiment, the high-speed measurement mode and the high-precision measurement mode are selectively used. Normally, the deviation amount in droplet ejection is measured for each nozzle 51 in the high-speed measurement mode, and droplet ejection is corrected for each nozzle 51 by the droplet ejection correction unit 126 in FIG. 1 on the basis of the deviation amount thus measured; however, if the deviation amount measured in the high-speed measurement mode does not satisfy prescribed conditions (more specifically, if the deviation amount is not within a prescribed range, or if the temporal variation in the deviation amount is not within a prescribed range), then the deviation amount in droplet ejection is measured for each nozzle 51 in the high-precision measurement mode, and droplet ejection is corrected for each nozzle 51 by the droplet ejection correction 124 in FIG. 1 on the basis of the deviation amounts thus measured in the high-precision measurement mode.

Figure 6:
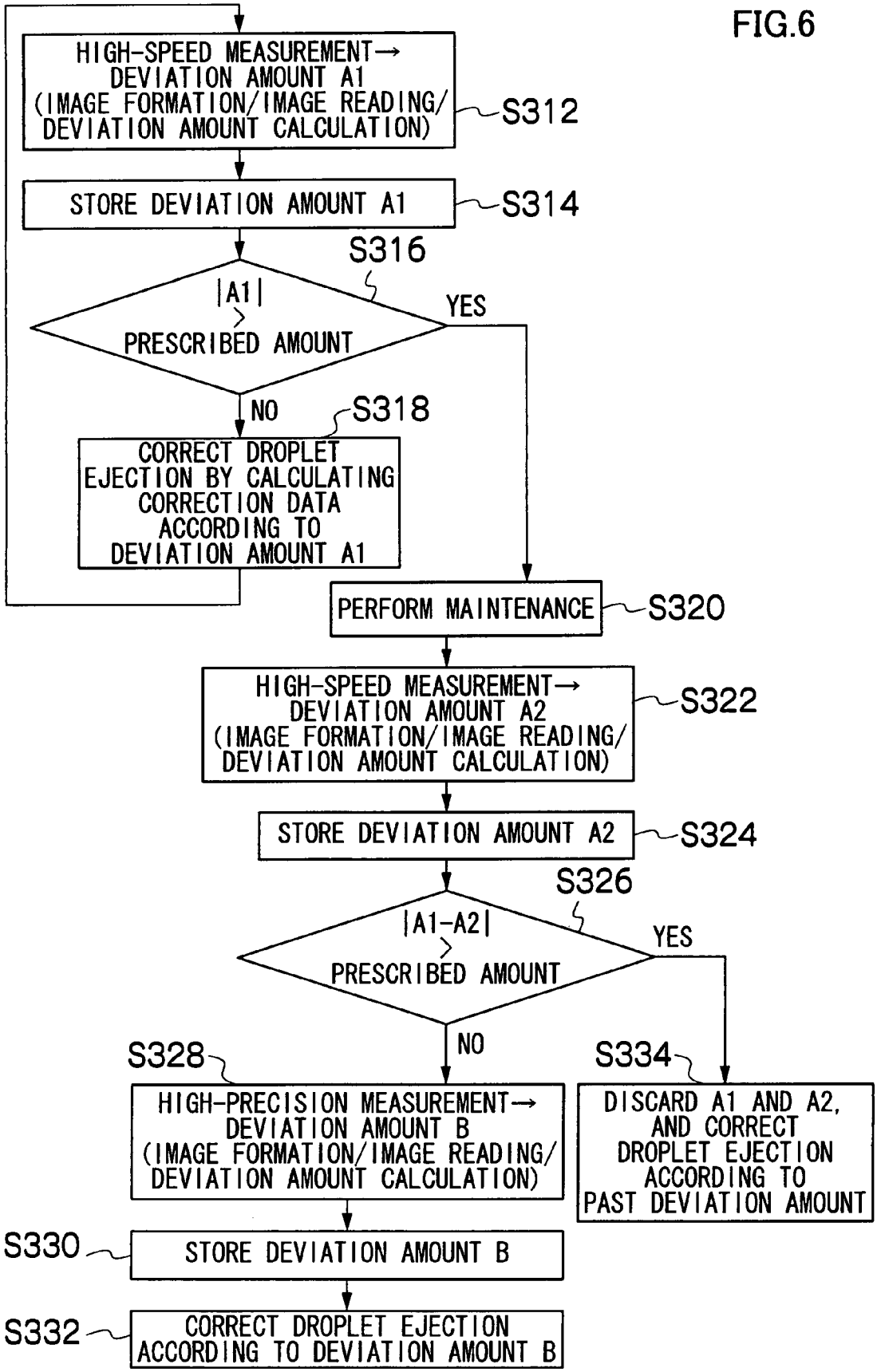
FIG. 6 is a flowchart showing an overview of a sequence of droplet ejection correction processing according to a third embodiment of the present invention.

Below, the droplet ejection correction processing according to the third embodiment of the present invention is described with reference to the flowchart in FIG. 6, which shows an overview of the sequence of this processing. The processing shown in FIG. 6 is performed by the control unit 150 in FIG. 1, in accordance with a prescribed program.

Normally, the deviation amount A1 in the droplet ejection from each nozzle 51 of the head 50 is measured in the high-speed measurement mode, by means of the head 50, the image reading unit 122 and the deviation amount calculation unit 124 shown in FIG. 1 (step S312), and the deviation amount A1 thus measured is stored in the storage unit 152 shown in FIG. 1 (step S314).

Thereupon, the deviation amount A1 measured in the high-speed measurement mode is compared with a prescribed amount stored previously in the storage unit 152 (namely, the maximum tolerable value of the deviation amount) (step S316).

Here, if the deviation amount A1 is not greater than the prescribed amount (in other words, if it is within the tolerable range), then correction data is calculated on the basis of the deviation amount A1 by the droplet ejection correction unit 126 in FIG. 1, and droplet ejection is corrected accordingly (step S318).

On the other hand, if the deviation amount A1 is greater than the prescribed amount at step S316, then the maintenance unit 102 in FIG. 1 performs a maintenance operation for the head 50 (step S320). After performing the maintenance operation, the deviation amount A2 in the droplet ejection from each nozzle 51 of the head 50 is again measured in the high-speed measurement mode (step S322), and the deviation amount A2 thus measured is stored in the storage unit 152 shown in FIG. 1 (step S324).

Thereupon, the differential |A1−A2| between the deviation amount A1 measured immediately before the maintenance operation and the deviation amount A2 measured immediately after the maintenance operation (i.e., the temporal variation in the deviation amount) is calculated and compared with a prescribed amount (i.e., the maximum tolerable variation) beforehand stored in the storage unit 152 (step S326).

Then, if the differential |A1−A2| is not greater than the prescribed amount (i.e., if the temporal variation in the deviation amount is within the tolerable range), then the deviation amount B in droplet ejection is measured in the high-precision measurement mode (step S328), and the deviation amount B thus measured is stored in the storage unit 152 in FIG. 1 (step S330). Thereupon, droplet ejection correction is performed by calculating correction data on the basis of the deviation amount B, by means of the droplet ejection correction unit 126 in FIG. 1 (step S332).

In general, the droplet ejection correction is not performed by performing droplet ejection again toward the medium 16 on which an image has already been formed and from which the image has been read in, but by correcting droplet ejection toward the next medium that is relatively moved to the position opposing the head 50. More specifically, firstly, there is a mode in which the droplet deposition pattern data (which is generated by the droplet deposition pattern generation unit 114 in FIG. 1) of the image that is to be formed on the next medium is corrected, and secondly, there is a mode in which the drive signals (which are generated by the head drive unit 116 in FIG. 1) applied to the head 50 during droplet ejection toward the next medium are corrected, and the like.

If the differential |A1−A2| is greater than the prescribed amount at step S326, then the deviation amount A1 and the deviation amount A2 are discarded in such a manner that they are not used in droplet ejection correction, in other words, any deviation amounts from a period of time in which the variation in the deviation amounts exceeds a tolerable range are discarded, and droplet ejection correction is performed by calculating correction data on the basis of the past deviation amounts stored in the storage unit 152 in FIG. 1 (step S334). In short, the droplet ejection is corrected on the basis of the deviation amounts relating to a period where the variation in the deviation amounts is within the tolerable range.

Here, there are various modes for comparing the measured deviation amount with a prescribed amount (threshold value) that has been stored previously, in other words, modes for judging the deviation amount in step S316. The threshold value of the deviation amount indicates a value beyond which droplet ejection correction cannot be performed, in other words, it indicates the maximum tolerable value for correction of droplet ejection.

Firstly, there is a judgment mode in which it is judged whether or not the deviation amount of nozzles 51 (adjacent nozzles) which form dots that are mutually adjacent on the medium 16 is greater than the threshold value, in the case of both nozzles 51, and if the deviation amount is greater than the threshold value for both nozzles, then a maintenance operation (step S320) is performed. For example, a maintenance operation is performed when ejection has become impossible from two nozzles adjacent to each other.

Secondly, there is a judgment mode in which it is judged whether or not the deviation amount is greater than the threshold value, for each nozzle 51 individually, and if there is even one nozzle 51 having a deviation amount that is greater than the threshold value, then a maintenance operation (step S320) is performed. For example, a maintenance operation is performed when any one nozzle is suffering ejection failure.

Thirdly, there is a judgment mode in which a maintenance operation (step S320) is performed if the number of nozzles 51 having deviation amounts greater than the threshold value has exceeded a previously established prescribed number (a number threshold value).

Fourthly, there is a judgment mode in which, if the sum of the absolute values of the deviation amounts for the nozzles 51 exceeds a threshold value previously established for comparing with this sum of absolute values, then maintenance (step S320) is performed. In general, the value (sum total) obtained by adding up the absolute values of the deviation amounts for all of the nozzles 51 gradually increases over time, and if there is a large number of nozzles 51, then the temporal change in this sum is substantially similar, regardless of external factors. Therefore, it is logical to use the sum total of the absolute values of the deviation amounts, as in this fourth judgment mode. By setting the threshold value in such a manner that when this threshold value is exceeded, there still remains some margin of time before the occurrence of nozzles 51 in which droplet ejection correction is impossible, then it is possible to prevent the occurrence of uncorrectable nozzles, even if measurement is made intermittently.

In the case of the third judgment mode and the fourth judgment mode, it is possible to reduce the frequency of measurement of the deviation amount, in comparison with the first judgment mode or the second judgment mode.

As described above, in the third embodiment, the control unit 150 in FIG. 1 normally measures the deviation amount in droplet ejection of the nozzles 51 in the high-speed measurement mode, and corrects the droplet ejection of the nozzles 51 by means of the droplet ejection correction unit 126, on the basis of the deviation amount thus measured, but if the deviation amount does not satisfy prescribed conditions, then the control unit 150 measures the deviation amount in droplet ejection of the nozzles 51 in the high-precision measurement mode, and corrects the droplet ejection of the nozzles 51 by means of the droplet ejection correction unit 126, on the basis of the deviation amount thus measured in the high-precision measurement mode.

Furthermore, for each of the nozzles 51, the control unit 150 in FIG. 1 compares the temporal variation in the deviation amount in droplet ejection for that nozzle 51, with a prescribed maximum tolerable value stored in the storage unit 152, and discards any of the deviation amounts in droplet ejection for that nozzle 51 relating to the period in which the temporal variation in the deviation amount in droplet ejection for that nozzle 51 exceeded a maximum tolerable value, in such a manner that such deviation amount values are not used in the correction of the droplet ejection of that nozzle 51.

Fourth Embodiment

Next, the droplet ejection correction processing according to a fourth embodiment of the present invention is described.

In the fourth embodiment, similarly to the third embodiment, the high-precision measurement mode and the high-speed measurement mode are selectively used. These measurement modes have already been explained in the third embodiment, and therefore further description thereof is omitted here.

Below, the droplet ejection correction processing according to the fourth embodiment of the present invention is described with reference to the flowchart in FIG. 7, which shows an overview of the sequence of this processing. The processing shown in FIG. 7 is performed by the control unit 150 in FIG. 1, in accordance with a prescribed program.

When the image forming apparatus 10 is started up, a maintenance operation is performed in the head 50 of the FIG. 1, by the maintenance unit 102 in FIG. 1 (step S402), and immediately thereafter the deviation amount B in droplet ejection of each nozzle 51 of the head 50 in FIG. 1 is measured by using the head 50, the image reading unit 122 and the deviation amount calculation unit 124 in FIG. 1, in the high-precision measurement mode (step S404), and the deviation amount B thus measured is stored in the storage unit 152 in FIG. 1 (step S406).

Figure 7:
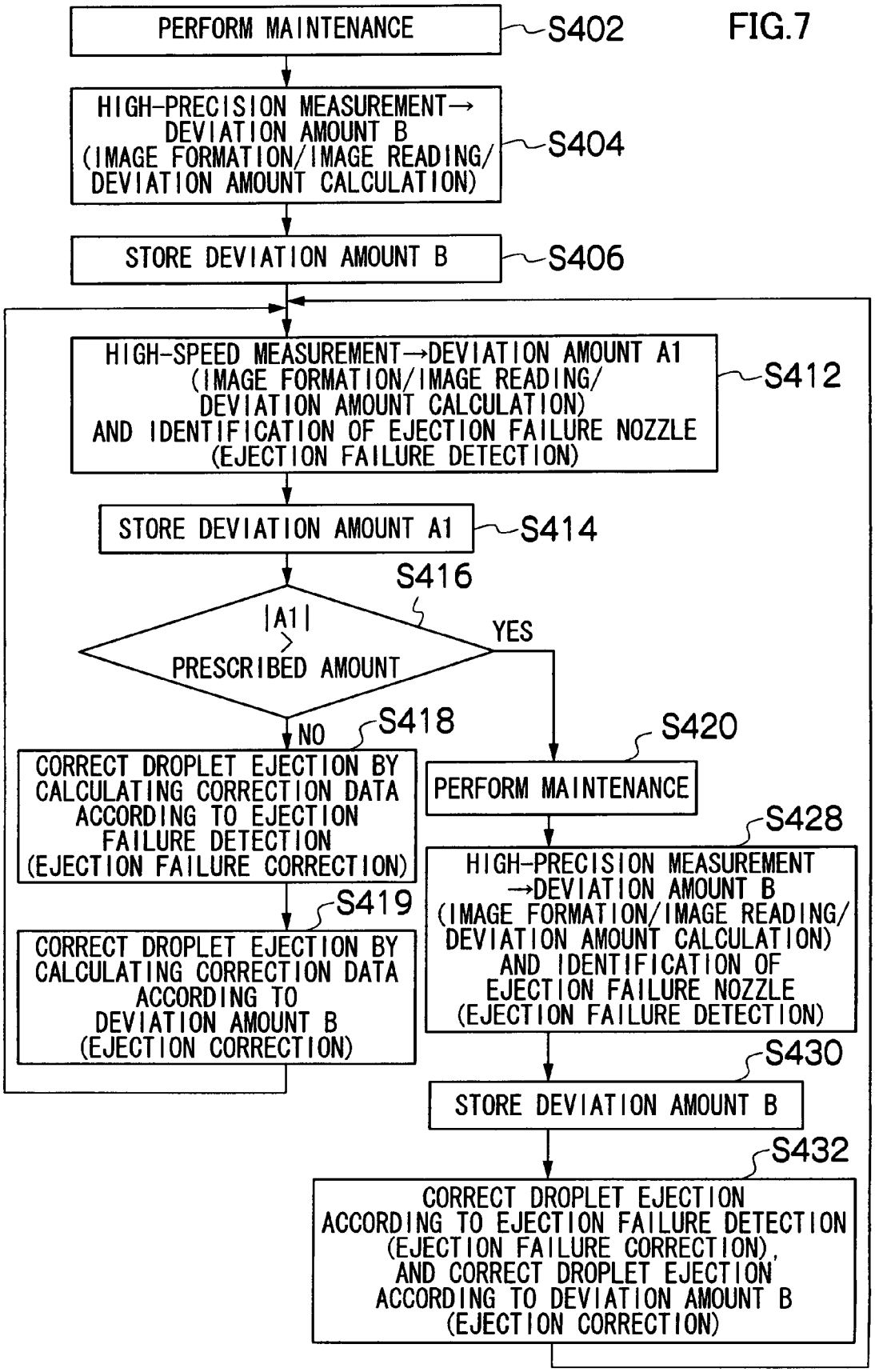
FIG. 7 is a flowchart showing an overview of a sequence of droplet ejection correction processing according to a fourth embodiment of the present invention.

After step S406 in FIG. 7, the left-hand side loop (S412→S414→S416→S418→S419→S412) is a sequence of droplet ejection correction processing during normal printing in which no maintenance is necessary, and the right-hand side loop (S412→S414→S416→S420→S428→S430→S432→S412) is a sequence of droplet ejection correction processing during printing where maintenance is necessary.

Normally, the deviation amount A1 in droplet ejection of each nozzle 51 of the head 50 in FIG. 1 is measured in the high-speed measurement mode, and the nozzle suffering ejection failure is identified (ejection failure detection is performed) (step S412), and the measured deviation amount A1 and the ejection failure nozzle identification information is stored in the storage unit 152 in FIG. 1 (step S414).

The step of judging whether or not it is necessary to perform maintenance by comparing the deviation amount A1 with a previously established prescribed amount (threshold value) (S416) involves similar judgment processing to the judgment step (S316) in the third embodiment shown in FIG. 6. This judgment processing has already been described in detail in respect of the third embodiment, and therefore, further explanation thereof is omitted here.

Here, if the deviation amount A1 is not greater than the prescribed amount (threshold value) (in other words, if it is within the tolerable range), then droplet ejection is corrected by calculating correction data on the basis of the result of the ejection failure detection in step S412 (the ejection failure nozzle identification information) (step S418) (hereinafter, this correction is called "ejection failure correction"), and furthermore, droplet ejection is corrected by calculating correction data on the basis of the deviation amount B measured in the high-precision measurement mode and stored in the storage unit 152 (step S419), (hereinafter, this correction is called "ejection correction").

In the case of "ejection failure correction", correction is performed by increasing the droplet ejection volume (or by increasing the droplet ejection rate), in respect of the nozzles that are adjacent to the ejection failure nozzle (or the nozzles that are in the peripheral region of the ejection failure nozzle). In addition, correction may also be implemented in order to stop the driving of the piezoelectric actuator 58 corresponding to the nozzle that is suffering the ejection failure, thereby preventing wasteful consumption of power.

In the case of "ejection correction", if the deviation amount B corresponding to the nozzle under consideration is outside the tolerable range, then correction is performed by, for instance, increasing or decreasing the droplet ejection volume (or increasing or decreasing the droplet ejection rate) relating to the nozzle under consideration and the nozzles that are adjacent to the nozzle under consideration (or relating to the nozzle under consideration and the nozzles in the peripheral region of the nozzle under consideration).

During normal printing, it is expected that the nozzles 51 perform ejection at a certain operating rate or above, and therefore, a state where the deviation amount A1 is not greater than the threshold value, in other words, a state where the viscosity of the ink in the nozzles 51 is stable and no maintenance is necessary, continues for a certain amount of time. In this state where no maintenance is necessary, it is sufficient to repeat the steps of ejection failure detection by the high-speed measurement (step S412) and "ejection failure correction" (step S418), and "ejection correction" (step S419) based on the deviation amount B. Therefore, the loop that does not require maintenance (S412 to S419) is repeated. Consequently, printing is continued while performing the high-speed measurement only, and hence there is no reduction in productivity.

On the other hand, if the deviation amount A1 is greater than the prescribed amount, then the maintenance unit 102 in FIG. 1 performs the maintenance operation with respect to the head 50 in FIG. 1 (step S420), and immediately after this maintenance operation, the deviation amount B in droplet ejection is measured in the high-precision measurement mode, and furthermore the ejection failure nozzles are identified (ejection failure detection is performed) (step S428). Thereupon, the deviation amount B thus measured, and the ejection failure identification information, are stored in the storage unit 152 in FIG. 1 (step S430). The droplet ejection correction unit 126 in FIG. 1 then performs droplet ejection correction (ejection failure correction) based on the results of the ejection failure detection in step S428 (on the basis of the ejection failure nozzle identification information), and droplet ejection correction (ejection correction) on the basis of the deviation amount B (step S432).

As stated above, in the fourth embodiment, the control unit 150 in FIG. 1 measures the deviation amounts in droplet ejection of the nozzles 51, in high-precision measurement mode, and stores the deviation amounts thus measured in the storage unit 152; normally, the control unit 150 measures the deviation amounts in droplet ejection of the nozzles 51 in the high-speed measurement mode, performs ejection failure detection on the basis of these deviation amounts, and implements droplet ejection correction (ejection failure correction) by means of the droplet ejection correction unit 126, on the basis of the results of this droplet ejection detection, while at the same time, it implements droplet ejection correction (ejection correction) for the nozzles 51 by means of the droplet ejection correction unit 126, on the basis of the deviation amounts in droplet ejection of the nozzles 51 measured in the past in the high-precision measurement mode and stored in the storage unit 152.

Embodiment of Mechanical Composition of Image Forming Apparatus

Figure 8:
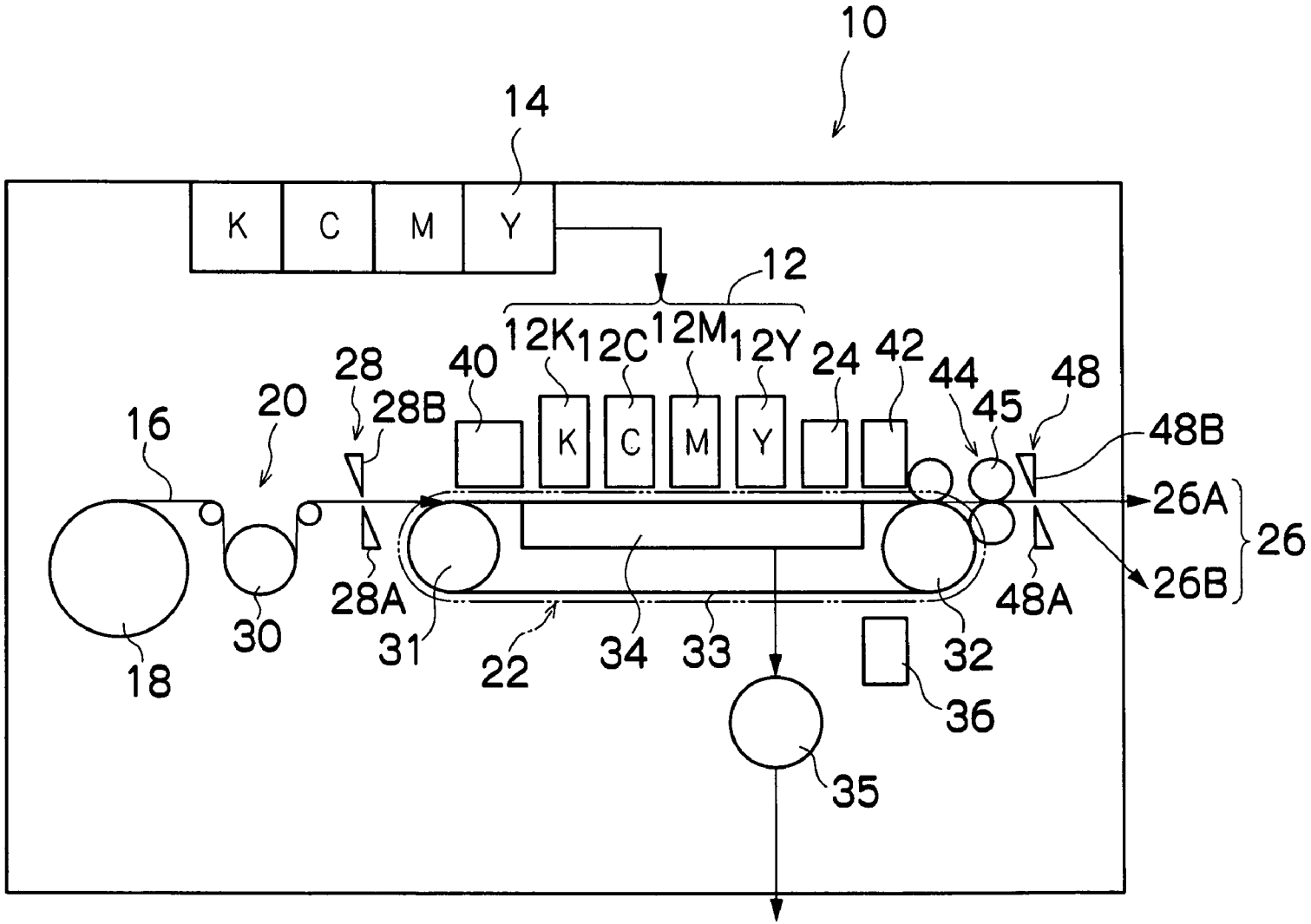
FIG. 8 is an overall compositional diagram showing the mechanical composition of the image forming apparatus according to an embodiment of the present invention.

FIG. 8 is a general schematic drawing showing the mechanical composition of the image forming apparatus 10 according to an embodiment of the present invention. As shown in FIG. 8, this image forming apparatus 10 includes: a droplet ejection unit 12 having a plurality of heads 50 as shown in FIG. 1 provided for respective ink colors, namely, heads 12K (black ink head), 12C (cyan ink head), 12M (magenta ink head) and 12Y (yellow ink head); an ink storing and loading unit 14, which stores inks to be supplied to the respective heads 12K, 12C, 12M and 12Y; a paper supply unit 18, which supplies a medium 16, such as paper; a decurling unit 20, which removes curl from the medium 16; a suction belt conveyance unit 22, disposed facing the nozzle faces (droplet ejection faces) of the heads 12K, 12C, 12M and 12Y, which conveys the medium 16 while keeping the medium 16 flat; an image sensor 24 forming the image reading unit 122, which reads in an image produced by droplet ejection from the droplet ejection unit 12; and a paper output unit 26, which outputs a printed medium (printed matter) to the exterior.

In FIG. 8, a magazine for rolled paper (continuous medium) is shown as an embodiment of the paper supply unit 18; however, more magazines with different medium width and quality may be jointly provided. Moreover, the medium may be supplied with cassettes that contain cut papers loaded in layers and that are used jointly or in lieu of the magazine for rolled paper.

In the case of a configuration in which a plurality of types of media can be used, it is preferable that an information recording medium such as a bar code and a wireless tag containing information about the type of medium 16 is attached to the magazine, and by reading the information contained in the information recording medium with a predetermined reading device, the type of medium to be used is automatically determined, and ink-droplet ejection is controlled so that the ink-droplets are ejected in an appropriate manner in accordance with the type of medium.

The medium 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the medium 16 has a curl in which the surface on which the print is to be made is slightly round outward.

In the case of the configuration in which roll paper is used, a cutter (first cutter) 28 is provided as shown in FIG. 8, and the continuous paper is cut into a desired size by the cutter 28. The cutter 28 has a stationary blade 28A, whose length is not less than the width of the conveyor pathway of the medium 16, and a round blade 28B, which moves along the stationary blade 28A. The stationary blade 28A is disposed on the reverse side of the printed surface of the medium 16, and the round blade 28B is disposed on the printed surface side of the medium 16 across the conveyor pathway. When cut papers are used, the cutter 28 is not required.

The decurled and cut medium 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the droplet ejection unit 12 and the sensor face of the image sensor 24 forms a horizontal plane (flat plane).

The belt 33 has a width that is greater than the width of the medium 16, and a plurality of suction apertures (not shown) are formed on the belt surface. A suction chamber 34 is disposed in a position facing the sensor surface of the image sensor 24 and the nozzle face of the droplet ejection unit 12 on the interior side of the belt 33, which is set around the rollers 31 and 32, as shown in FIG. 8. The suction chamber 34 provides suction with a fan 35 to generate a negative pressure, and the recording paper 16 on the belt 33 is held by suction.

The belt 33 is driven in the clockwise direction in FIG. 8 by the motive force of a motor being transmitted to at least one of the rollers 31 and 32, which the belt 33 is set around, and the medium 16 held on the belt 33 is conveyed from left to right in FIG. 8.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which nipping with a brush roller and a water absorbent roller or the like, an air blow configuration in which clean air is blown, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the medium immediately after printing. Therefore, the suction belt conveyance in which nothing comes into contact with the image surface in the printing area is preferable.

A heating fan 40 is disposed on the upstream side of the droplet ejection unit 12 in the medium conveyance pathway formed by the suction belt conveyance unit 22. The heating fan 40 blows heated air onto the medium 16 to heat the medium 16 immediately before printing so that the ink deposited on the medium 16 dries more easily.

Figure 9:
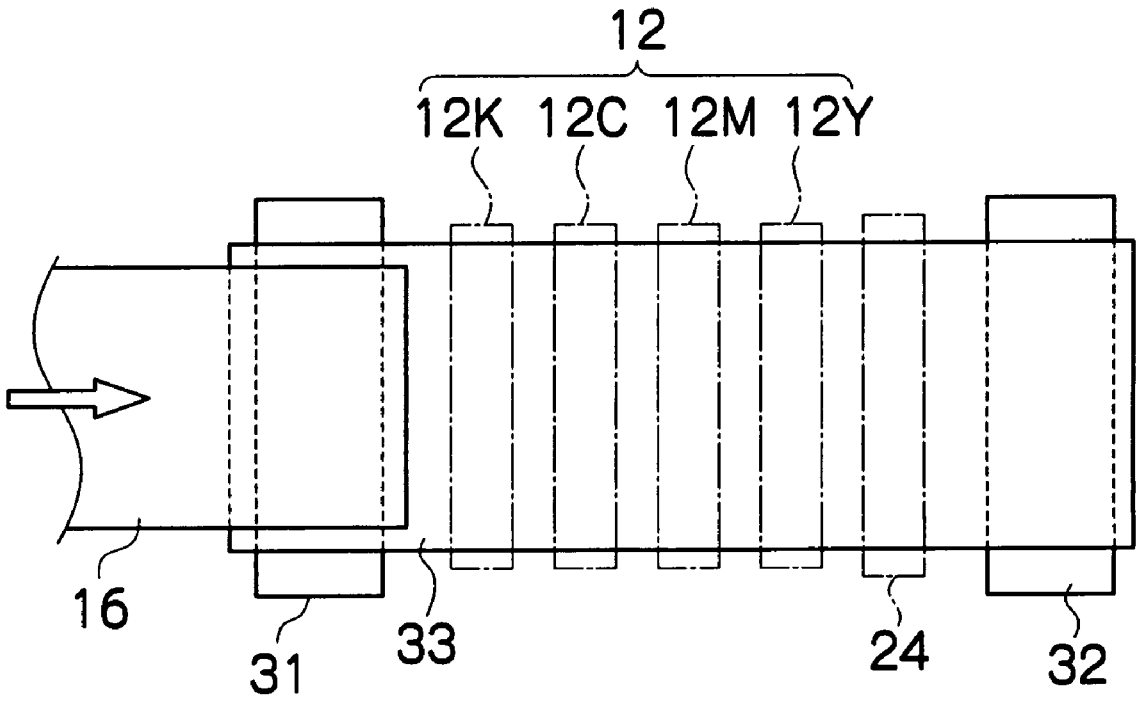
FIG. 9 is a plan diagram showing the arrangement of the heads and the image reading unit in the image forming apparatus.

The droplet ejection unit 12 is a so-called "full line head" in which a line head having a length corresponding to the maximum paper width is arranged in a direction that is perpendicular to the paper feed direction (medium conveyance direction) (see FIG. 9). Each of the heads 12K, 12C, 12M and 12Y is constituted by a full line head, in which a plurality of ink droplet ejection ports (nozzles) are arranged through a length that exceeds at least one side of the maximum-size medium 16 intended for use in the image forming apparatus 10, as shown in FIG. 9.

The print heads 12K, 12C, 12M and 12Y are arranged in the order of black (K), cyan (C), magenta (M), and yellow (Y) from the upstream side, along the feed direction of the recording paper 16 (hereinafter, referred to as the sub-scanning direction). A color image can be formed on the recording paper 16 by ejecting the inks from the print heads 12K, 12C, 12M and 12Y, respectively, onto the recording paper 16 while conveying the recording paper 16.

The droplet ejection unit 12, in which the full-line heads covering the entire width of the paper are thus provided for the respective ink colors, can record an image over the entire surface of the medium 16 by performing the action of moving the medium 16 and the droplet ejection unit 12 relatively to each other in the medium conveyance direction just once (in other words, by means of a single scan in the medium conveyance direction). In this way, it is possible to achieve higher-speed printing and to improve productivity in comparison with a shuttle scanning type of head configuration, in which a head moves reciprocally in a direction that is substantially perpendicular to the medium conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As shown in FIG. 8, the ink storing and loading unit 14 has ink tanks for storing the inks of the colors corresponding to the respective print heads 12K, 12C, 12M and 12Y, and the respective tanks are connected to the print heads 12K, 12C, 12M and 12Y by means of channels (not shown). The ink storing and loading unit 14 has a warning device (for example, a display device or an alarm sound generator) for warning when the remaining amount of any ink is low, and has a mechanism for preventing loading errors among the colors.

The image sensor 24 reads in the droplet ejection results of the droplet ejection unit 12, and the occurrence of nozzle blockages or other droplet ejection defects and droplet ejection variations is determined from the read image data obtained from the image sensor 24.

The image sensor 24 of the present embodiment is configured with at least a line sensor having rows of photoelectric transducing elements with a width that is greater than the ink-droplet ejection width (image forming width) of the heads 12K, 12C, 12M and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The image sensor 24 according to the present embodiment reads in an image (which may be a test pattern or an actual image) that has been formed by the heads 12K, 12C, 12M and 12Y of the respective colors, and determines the droplet ejection variations for each head. Judgment of droplet ejection variations includes determining the presence or absence of ejected droplets (dots), and measuring the droplet deposition positions (dot positions), the ejected droplet diameters (dot diameters), the density, and the like. The image sensor 24 is provided with a light source (not illustrated) which irradiates light onto the deposited dots.

A post-drying unit 42 is disposed following the image sensor 24. The post-drying unit 42 is a device to dry the printed image surface, and includes a heating fan, for example. It is preferable to avoid contact with the printed surface until the ejected ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the image forming apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large medium, the test print image is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 8, the paper output unit 26A for the target prints is provided with a sorter for collecting prints according to print orders. The numeral 26B signifies a test paper output unit.

The foregoing description related to the embodiment where the relative movement between the liquid ejection heads 50 formed with the nozzles 51 and the medium 16 is achieved by moving the medium 16 with respect to the fixed liquid ejection heads 50, but the present invention is not limited to cases of this kind, and the present invention can also be applied to a case where the medium 16 is fixed and the liquid ejection heads 50 are moved, or to a case where both the liquid ejection heads 50 and the medium 16 are moved.

Furthermore, the head that uses the piezoelectric bodies to eject droplets is described as the embodiment, but the present invention is not limited in particular to this and it can also be applied to a head that uses heaters to eject droplets.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an image forming device which has a plurality of nozzles performing droplet ejection of ink to deposit droplets of the ink to form an image onto a prescribed medium;

an image reading device which acquires read image data by reading in the image on the medium;

a deviation amount calculation device which, for each of the nozzles, calculates a deviation amount in the droplet ejection with respect to a prescribed central value according to the read image data;

a droplet ejection correction device which corrects the droplet ejection of each of the nozzles according to the deviation amount of the nozzle;

a storage device which stores a maximum tolerable value for a temporal variation in the deviation amount of each of the nozzles; and a control device which, for each of the nozzles, compares the temporal variation in the deviation amount with the maximum tolerable value stored in the storage device, and implements control which discards the deviation amount relating to a period where the temporal variation in the deviation amount exceeds the maximum tolerable value, in such a manner that that deviation amount is not used in correcting the droplet ejection of the nozzle.

2. The image forming apparatus as defined in claim 1, wherein the deviation amount includes one of a deviation amount in a position of a dot formed by the droplet of the ink deposited on the medium, a deviation amount in a size of the dot, and a deviation amount in density of the dot.

3. A droplet ejection correction method, comprising the steps of:

performing droplet ejection of ink from a plurality of nozzles to deposit droplets of the ink to form an image onto a prescribed medium;

acquiring read image data by reading in the image on the medium;

calculating, for each of the nozzles, a deviation amount in the droplet ejection with respect to a prescribed central value according to the read image data;

correcting the droplet ejection of each of the nozzles according to the deviation amount of the nozzle calculated in the calculating step; and comparing, for each of the nozzles, a temporal variation in the deviation amount with a maximum tolerable value stored in a prescribed storage device, and discarding the deviation amount relating to a period where the temporal variation in the deviation amount exceeds the maximum tolerable value, in such a manner that that deviation amount is not used in the correcting step.

4. The droplet ejection correction method as defined in claim 3, wherein the deviation amount includes one of a deviation amount in a position of a dot formed by the droplet of the ink deposited on the medium, a deviation amount in a size of the dot, and a deviation amount in density of the dot.

* * * * *